US009384693B2

(12) United States Patent
Chang et al.

(10) Patent No.: US 9,384,693 B2
(45) Date of Patent: Jul. 5, 2016

(54) PIXEL CIRCUIT AND DISPLAY APPARATUS USING THE SAME

(71) Applicant: AU Optronics Corp, Hsin-Chu (TW)

(72) Inventors: Hua-Gang Chang, Hsin-Chu (TW); Yu-Shian Lin, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 305 days.

(21) Appl. No.: 14/159,992

(22) Filed: Jan. 21, 2014

(65) Prior Publication Data

US 2014/0332775 A1 Nov. 13, 2014

(30) Foreign Application Priority Data

May 10, 2013 (TW) ..... 102116730 A

(51) Int. Cl.
*G09G 3/32* (2016.01)

(52) U.S. Cl.
CPC ..... *G09G 3/3233* (2013.01); *G09G 2300/0819* (2013.01); *G09G 2300/0842* (2013.01); *G09G 2300/0852* (2013.01); *G09G 2300/0861* (2013.01)

(58) Field of Classification Search
CPC ..... G09G 3/3233; G09G 2300/0819; G09G 2300/0842; G09G 2300/0852
See application file for complete search history.

(56) References Cited

U.S. PATENT DOCUMENTS

| | | | | |
|---|---|---|---|---|
| 7,564,452 | B2 | 7/2009 | Komiya et al. | |
| 2004/0183758 | A1 | 9/2004 | Chen et al. | |
| 2008/0143653 | A1* | 6/2008 | Shishido | G09G 3/3233 345/78 |
| 2011/0084947 | A1* | 4/2011 | Chung | G09G 3/3233 345/211 |
| 2011/0210958 | A1 | 9/2011 | Yoo et al. | |
| 2011/0227956 | A1 | 9/2011 | Park et al. | |

FOREIGN PATENT DOCUMENTS

| | | |
|---|---|---|
| CN | 101859542 A | 10/2010 |
| CN | 101996579 | 3/2011 |
| CN | 102194405 | 9/2011 |

OTHER PUBLICATIONS

China Patent Office, "Office Action", Mar. 23, 2014.

* cited by examiner

*Primary Examiner* — Shaheda Abdin
(74) *Attorney, Agent, or Firm* — WPAT, PC; Justin King

(57) ABSTRACT

A pixel circuit includes one organic light emitting diode, five first transistors and two capacitors. The first and third transistors have terminals coupled to a first voltage. The second transistor has two terminals coupled to another terminal of the first transistor and a second voltage through the organic light emitting diode, respectively. The first capacitor has a terminal coupled to one terminal of the second transistor. The third transistor has a terminal coupled to one terminal of the first capacitor. The second capacitor has two terminals coupled to a control terminal of the second transistor and another terminal of the first capacitor, respectively. The fourth transistor has two terminals coupled to the terminal of the second transistor and a control terminal of the second transistor, respectively. The fifth transistor has a terminal coupled to the another terminal of the second transistor. A display apparatus is also provided.

20 Claims, 12 Drawing Sheets

PIXEL CIRCUIT AND DISPLAY APPARATUS USING THE SAME

TECHNICAL FIELD

The present invention relates to a display technical field of organic light emitting diode (OLED), and more particularly to a pixel circuit employing an organic light emitting diode and a display apparatus using the aforementioned pixel circuit.

BACKGROUND

Basically, the conventional pixel circuit in an organic light emitting diode (OLED) display apparatus is mainly implemented by two transistors and one capacitor which are used for corporately controlling the brightness of the organic light emitting diode. However, the circuit design of the conventional pixel circuit may result in a non-uniformity issue.

FIG. 1 is a schematic circuit view of a conventional pixel circuit. As shown, the conventional pixel circuit 100 mainly includes two transistors 101 and 102, a capacitor 103 and an organic light emitting diode 110. Each one of the transistors 101 and 102 has a first terminal, a second terminal and a control terminal; and the capacitor 103 has a first terminal and a second terminal. Specifically, the transistor 101 is configured to have the first terminal thereof directly connected to a power voltage OVDD. The transistor 102 is configured to have the first terminal thereof for receiving display data DATA, the second terminal thereof electrically coupled to the control terminal of the transistor 101, and the control terminal thereof for receiving a scan signal SCAN. The capacitor 103 is configured to have the first terminal thereof directly connected to the first terminal of the transistor 101 as well as the power voltage OVDD and the second terminal thereof directly connected to the second terminal of the transistor 102 as well as the control terminal of the transistor 101. The organic light emitting diode 110 is configured to have the anode terminal thereof electrically coupled to the second terminal of the transistor 101 and the cathode terminal thereof directly connected to a power voltage OVSS. Through the aforementioned circuit configuration, the pixel circuit 100 may control the current flowing through the organic light emitting diode 110 according to the cross voltage between the control terminal of the transistor 101 (i.e., the connecting node G) and the second terminal of the transistor 101 (i.e., the connecting node S); wherein the current flowing through the organic light emitting diode 110 is obtained by the following equation:

$$I_{OLED}=K*(V_{GS}-|V_{TH}|)^2$$

where $I_{OLED}$ is the current flowing through the organic light emitting diode 110; K is a constant; $V_{GS}$ is a voltage difference between the connecting nodes G and S which are related to the power voltage OVDD and the display data DATA, respectively; and $V_{TH}$ is the threshold voltage of the transistor 101.

However, because each one of the pixel circuits 100 is electrically coupled to the power voltage OVDD through the respective metal line and each metal line may have an impedance which may lead to an IR-drop, the pixel circuits 100 may receive different power voltages OVDD and have different pixel currents $I_{OLED}$ flowing therein, and consequentially the pixel circuits 100 may have different brightness and thereby resulting in the non-uniformity issue. In addition, because the pixel transistors 101 in the respective pixel circuits 100 may have different threshold voltages $V_{TH}$ due to the different manufacturing processes, the pixel circuits 100 may have different pixel currents $I_{OLED}$ flowing therein, and consequentially the pixel circuits 100 may have different brightness and thereby resulting in the non-uniformity issue.

In addition, because the organic light emitting diode 110 may have an increasing resistance with the operation time and the material decay, the second terminal of the transistor 101 (i.e., the connecting node S) may have an increasing voltage and consequentially the transistor 101 may have a decreasing cross voltage $V_{GS}$ while the organic light emitting diode 110 has an increasing cross voltage. Thus, when the cross voltage $V_{GS}$ decreases and the current flowing through the transistor 101 correspondingly decreases, a decreasing $I_{OLED}$ is resulted in and consequentially the pixel circuits 100 may have decreasing brightness and thereby resulting in the non-uniformity issue.

SUMMARY

Thus, the present disclosure provides a pixel circuit capable of improving the non-uniformity issue of a related display panel.

The present disclosure provides a pixel circuit, which includes an organic light emitting diode, a first transistor, a second transistor, a first capacitor, a third transistor, a second capacitor, a fourth transistor and a fifth transistor. The first transistor is configured to have a first terminal thereof electrically coupled to a first power voltage. The second transistor is configured to have a first terminal thereof electrically coupled to a second terminal of the first transistor and a second terminal thereof electrically coupled to a second power voltage through the organic light emitting diode. The first capacitor is configured to have a first terminal thereof electrically coupled to the second terminal of the second transistor. The third transistor is configured to have a first terminal thereof electrically coupled to the first power voltage and a second terminal thereof electrically coupled to a second terminal of the first capacitor. The second capacitor is configured to have a first terminal thereof electrically coupled to a control terminal of the second transistor and a second terminal thereof electrically coupled to the second terminal of the first capacitor. The fourth transistor is configured to have a first terminal thereof electrically coupled to the first terminal of the second transistor and a second terminal thereof electrically coupled to a control terminal of the second transistor. The fifth transistor is configured to have a second terminal thereof electrically coupled to the second terminal of the second transistor.

The present disclosure further provides display apparatus including a plurality of pixel circuits. Each one of the pixel circuits includes an organic light emitting diode, a first transistor, a second transistor, a first capacitor, a third transistor, a second capacitor, a fourth transistor and a fifth transistor. The first transistor is configured to have a first terminal thereof electrically coupled to a first power voltage. The second transistor is configured to have a first terminal thereof electrically coupled to a second terminal of the first transistor and a second terminal thereof electrically coupled to a second power voltage through the organic light emitting diode. The first capacitor is configured to have a first terminal thereof electrically coupled to the second terminal of the second transistor. The third transistor is configured to have a first terminal thereof electrically coupled to the first power voltage and a second terminal thereof electrically coupled to a second terminal of the first capacitor. The second capacitor is configured to have a first terminal thereof electrically coupled to a control terminal of the second transistor and a second terminal thereof electrically coupled to the second terminal of the first capacitor. The fourth transistor is configured to have a first terminal thereof electrically coupled to the first terminal of the second transistor and a second terminal thereof electrically coupled to a control terminal of the second transistor. The fifth transistor is configured to have a second terminal thereof electrically coupled to the second terminal of the second transistor.

In summary, by using five transistors, two capacitors and one organic light emitting diode to implement the pixel circuit of the present disclosure, the pixel current flowing through the organic light emitting diode is only related to the threshold voltage of the organic light emitting diode and the display data and is unrelated to the power voltage and the threshold voltage of the transistor therein. Thus, the issues of the non-uniformity and the material decay of the organic light emitting diode can be improved effectively by the pixel circuit as well as the display apparatus employing the pixel circuit.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
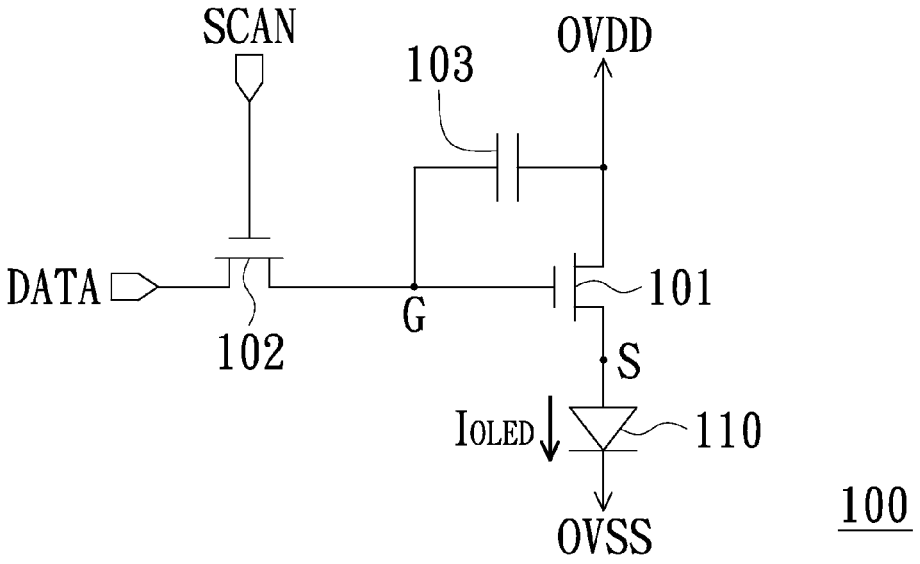
FIG. 1 (Prior Art)
FIG. 1 is a schematic circuit view of a conventional pixel circuit.
Figure 2:
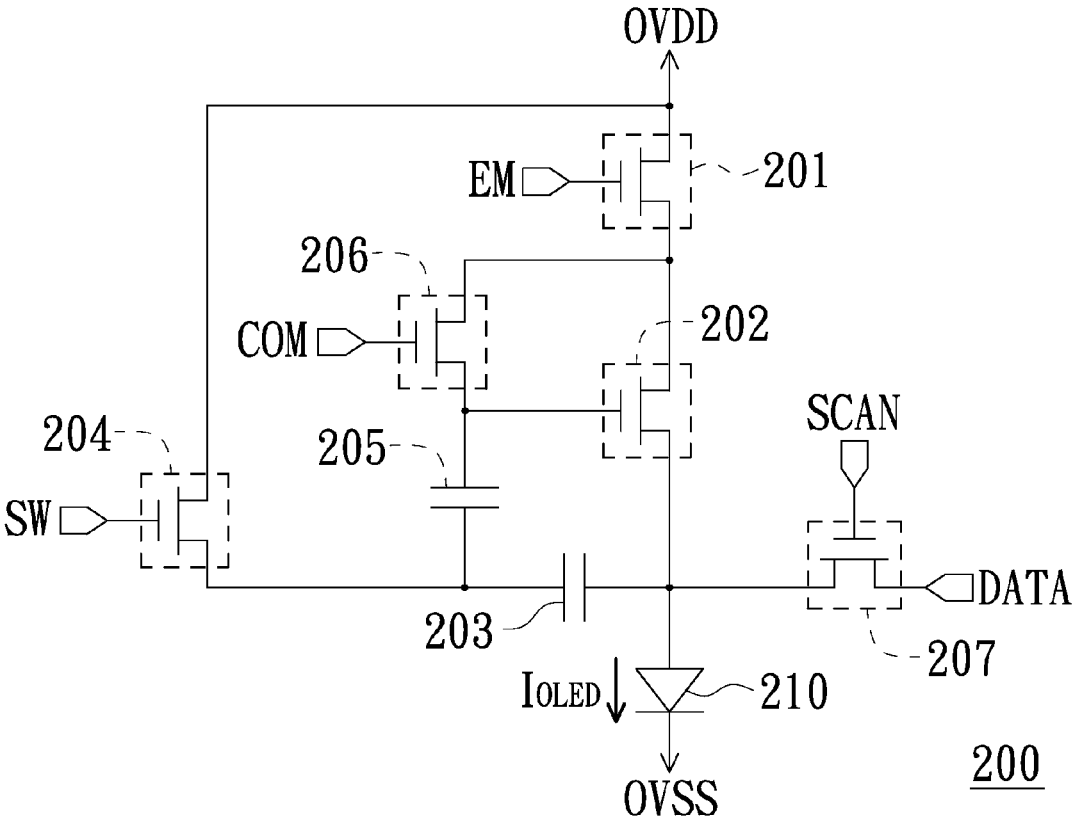
FIG. 2 is a schematic circuit view of a pixel circuit in accordance with an embodiment of the present disclosure.

FIG. 2 is a schematic circuit view of a pixel circuit in accordance with an embodiment of the present disclosure. As shown, the pixel circuit 200 in this embodiment includes five transistors 201, 202, 204, 206 and 207, two capacitors 203, 205 and an organic light emitting diode (OLED) 210. Each one of the transistors 201, 202, 204, 206 and 207 has a first terminal, a second terminal and a control terminal; and each one of the capacitors 203, 205 has a first terminal and a second terminal. Specifically, the transistor 201 is configured to have the first terminal thereof electrically coupled to a power voltage OVDD and the control terminal thereof for receiving an enable signal EM. The transistor 202 is configured to have the first terminal thereof electrically coupled to the second terminal of the transistor 201 and the second terminal thereof electrically coupled to a power voltage OVSS through the organic light emitting diode 210. The capacitor 203 is configured to have the first terminal thereof connected to the second terminal of the transistor 202. The transistor 204 is configured to have the first terminal thereof electrically coupled to the power voltage OVDD as well as the first terminal of the transistor 201 (or namely the first terminal of the transistor 204 is connected between the power voltage OVDD and the first terminal of the transistor 201), the second terminal thereof connected to the second terminal of the capacitor 203, and the control terminal thereof for receiving a switch signal SW. The capacitor 205 is configured to have the first terminal thereof electrically coupled to the control terminal of the transistor 202 and the second terminal thereof connected to the second terminal of the capacitor 203 as well as the second terminal of the transistor 204 (or namely the second terminal of the capacitor 205 is connected between the second terminal of the capacitor 203 and the second terminal of the transistor 204). The transistor 206 is configured to have the first terminal thereof electrically coupled to the first terminal of the transistor 202 as well as the second terminal of the transistor 201 (or namely the first terminal of the transistor 206 is connected between the first terminal of the transistor 202 and the second terminal of the transistor 201), the second terminal thereof electrically coupled to the control terminal of the transistor 202 as well as the first terminal of the capacitor 205 (or namely the second terminal of the transistor 206 is connected between the first terminal of the capacitor 205 and the control terminal of the transistor 202), and the control terminal thereof for receiving a common signal COM. The transistor 207 is configured to have the first terminal thereof for receiving display data DATA, the second terminal thereof electrically coupled to the second terminal of the transistor 202, the first terminal of the capacitor 203 as well as an anode terminal of the organic light emitting diode 210, and the control terminal thereof for receiving a scan signal SCAN. The organic light emitting diode 210 is configured to have the anode terminal thereof connected to the second terminal of the transistor 202 and a cathode terminal thereof connected to the power voltage OVSS. In this embodiment, the power voltage OVDD is configured to have a voltage value greater than that of the power voltage OVSS; each one of the five transistors 201, 202, 204, 206 and 207 is an N-type transistor, which may be implemented by an N-type thin film transistor.

Figure 3:
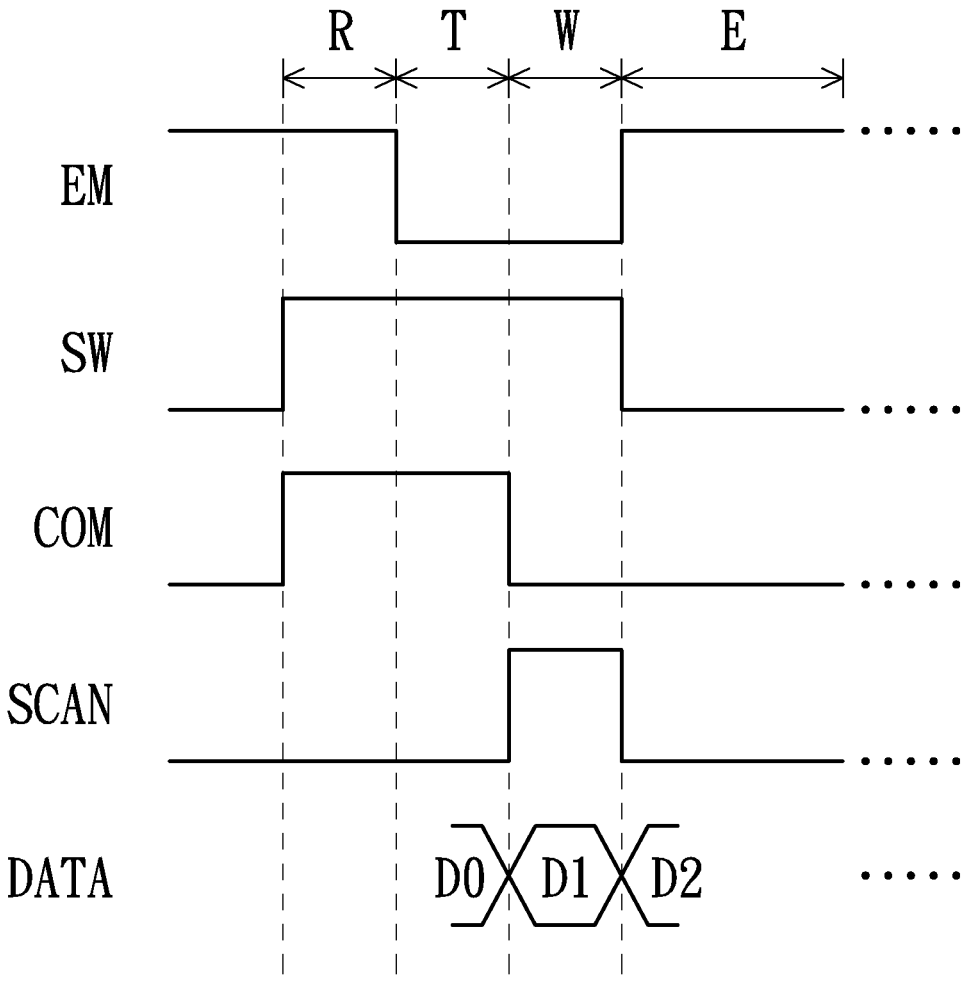
FIG. 3 is a schematic timing sequence view of the signals associated with the pixel circuit of FIG. 2.

FIG. 3 is a schematic timing sequence view of the signals associated with the pixel circuit 200 of FIG. 2. As shown, the pixel circuit 200 may be operated in a reset phase R, a charging phase T, a data writing phase W or an emission phase E; wherein the reset phase R, charging phase T, data writing phase W and emission phase E are executed sequentially and repeatedly. In addition, it is understood that each one of the enable signal EM, switch signal SW, common signal COM and scan signal SCAN may be configured to have either a high level or a low level.

Please refer to both of FIGS. 2 and 3. In the reset phase R, the enable signal EM, the switch signal SW and the common signal COM are configured to have high levels and the scan signal SCAN is configured to have a low level. Accordingly, the transistors 201, 204 and 206 are turned on and the transistor 207 is turned off. Thus, an equivalent circuit of the pixel circuit 200 operated in the reset phase R is obtained as illustrated in FIG. 4A.

Figure 4A:
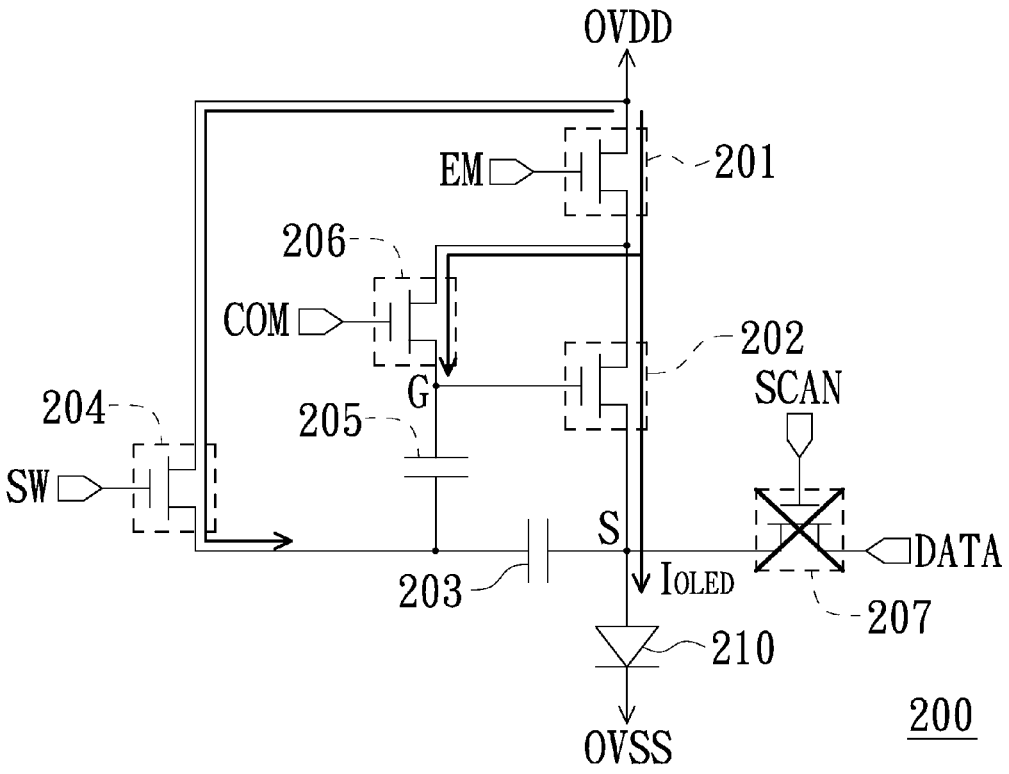
FIG. 4A is an equivalent circuit view of the pixel circuit of FIG. 2 operated in the reset phase.

As illustrated in FIG. 4A, the voltage values of connecting nodes G and S are obtained by the equations (1) and (2), respectively, which are:

$$V_{G=OVDD} \quad (1)$$

$$V_S=V_{SO}+V_{OLED_R} \quad (2)$$

where $V_G$ is the voltage value of the connecting node G; $V_S$ is the voltage value of the connecting node S; $V_{SO}$ is the threshold voltage of the organic light emitting diode 210; $V_{OLED_R}$ is the cross voltage on the organic light emitting diode 210 in the reset phase R.

Figure 4B:
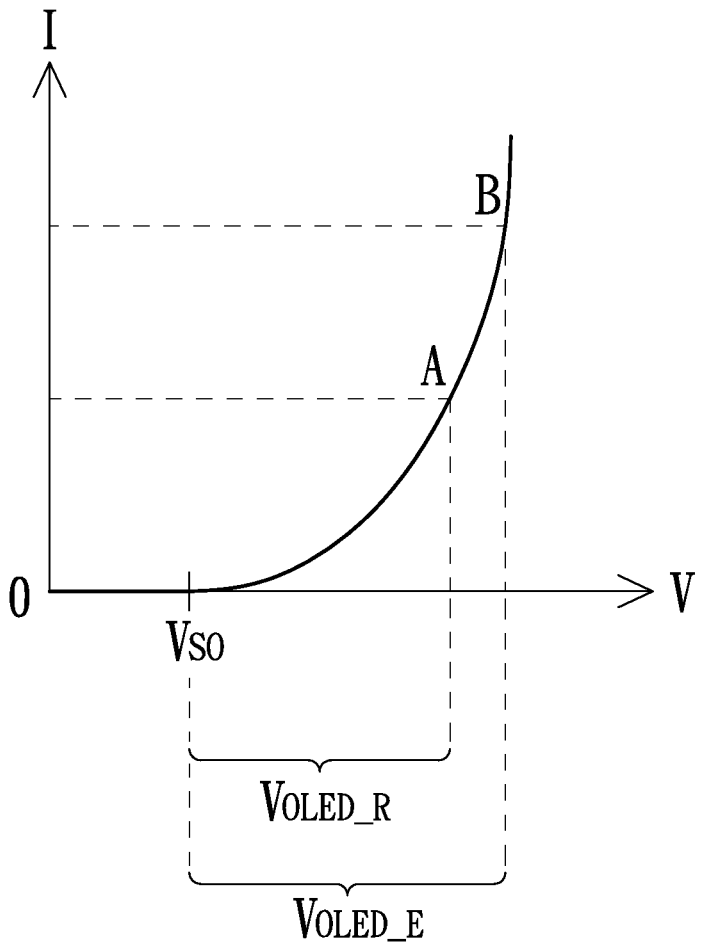
FIG. 4B is a schematic current-voltage chart of an organic light emitting diode.

As shown in equations (1) and (2), in the reset phase R, the voltage value of the control terminal of the transistor 202 (i.e., the connecting node G) is related to the power voltage OVDD and the voltage value of the second terminal of the transistor 202 (i.e., the connecting node S) is related to the threshold voltage of the organic light emitting diode 210 and the cross voltage on the organic light emitting diode 210. In addition, the organic light emitting diode 210 has an operation point A while being operated in the reset phase R as illustrated in FIG. 4B, which is a schematic current-voltage chart of the organic light emitting diode 210.

Please refer to both of FIGS. 2 and 3 again. In the charging phase T, the enable signal EM and the scan signal SCAN are configured to have low levels and the switch signal SW and the common signal COM are configured to have high levels. Accordingly, the transistors 201 and 207 are turned off and the transistors 204 and 206 are turned on. Thus, an equivalent circuit of the pixel circuit 200 operated in the charging phase T is obtained as illustrated in FIG. 4C.

Figure 4C:
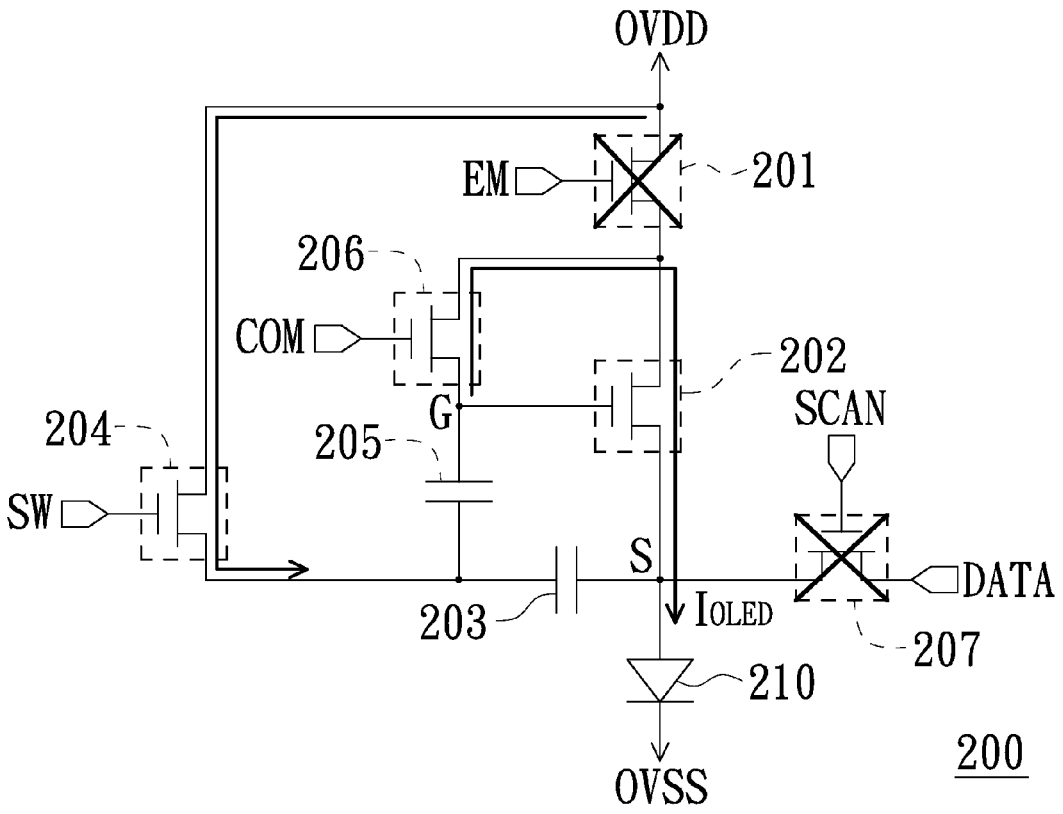
FIG. 4C is an equivalent circuit view of the pixel circuit of FIG. 2 operated in the charging phase.

As illustrated in FIG. 4C, the voltage values of the connecting nodes G and S are obtained by the equations (3) and (4), respectively, which are:

$$V_G=V_{SO}+V_{TH} \quad (3)$$

$$V_S=V_{SO} \quad (4)$$

where $V_G$ is the voltage value of the connecting node G; $V_S$ is the voltage value of the connecting node S; $V_{SO}$ is the threshold voltage of the organic light emitting diode 210; and $V_{TH}$ is the threshold voltage of the transistor 202.

As shown in equations (3) and (4), in the charging phase T, the voltage value of the control terminal of the transistor 202 (i.e., the connecting node G) is related to the threshold voltage $V_{SO}$ of the organic light emitting diode 210 and the threshold voltage $V_{TH}$ of the transistor 202 and the voltage value of the second terminal of the transistor 202 (i.e., the connecting node S) is related to the threshold voltage $V_{SO}$ of the organic light emitting diode 210. Specifically, in the charging phase T, the voltage at the connecting node G is discharged toward the connecting node S until the voltage $V_S$ drops to $V_{SO}$ and thereby configuring the organic light emitting diode 210 to be turned off. Similarly, the cross voltage between the control and second terminals of the transistor 202 (i.e., $V_{GS}$) may also drop to $V_{TH}$ and thereby configuring the transistor 202 to be turned off.

Please refer to both of FIGS. 2 and 3 again. In the data writing phase W, the enable signal EM and the common signal COM are configured to have low levels and the switch signal SW and the scan signal SCAN are configured to have high levels. Accordingly, the transistors 201 and 206 are turned off and the transistors 204 and 207 are turned on. Thus, an equivalent circuit of the pixel circuit 200 operated in the data writing phase W is obtained as illustrated in FIG. 4D.

Figure 4D:
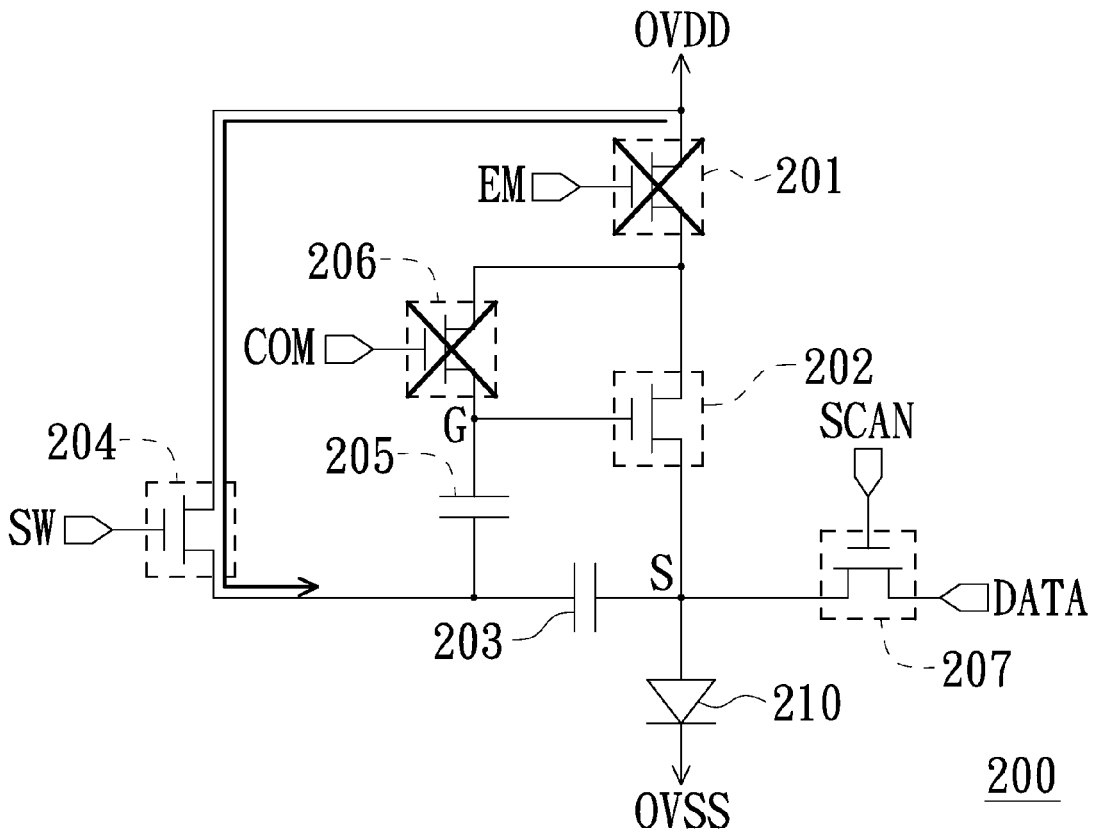
FIG. 4D is an equivalent circuit view of the pixel circuit of FIG. 2 operated in the data writing phase.

As illustrated in FIG. 4D, the voltage values of the connecting nodes G and S are obtained by the equations (5) and (6), respectively, which are:

$$V_G=V_{SO}+V_{TH} \quad (5)$$

$$V_S=V_{DATA} \quad (6)$$

where $V_G$ is the voltage value of the connecting node G; $V_S$ is the voltage value of the connecting node S; $V_{SO}$ is the threshold voltage of the organic light emitting diode 210; $V_{TH}$ is the threshold voltage of the transistor 202; and $V_{DATA}$ is the voltage value of the display data DATA.

As shown in equations (5) and (6), in the data writing phase W, the voltage value of the control terminal of the transistor 202 (i.e., the connecting node G) is related to the threshold voltage $V_{SO}$ of the organic light emitting diode 210 and the threshold voltage $V_{TH}$ of the transistor 202 and the voltage value of the second terminal of the transistor 202 (i.e., the connecting node S) is related to the voltage value of the display data DATA. Specifically, in the data writing phase W, because the transistor 206 is tuned off and the transistor 204 is turned on, the voltage value of the second terminals of the capacitors 203, 205 is OVDD and accordingly the voltage value at the connecting node G is maintained at $(V_{SO}+V_{TH})$. In addition, the voltage value at the connecting node S changes from $V_{SO}$ to $V_{DATA}$.

Please refer to both of FIGS. 2 and 3 again. In the emission phase E, the enable signal EM is configured to have a high level and the common signal COM, the switch signal SW and the scan signal SCAN are configured to have low levels. Accordingly, the transistor 201 is turned on and the transistors 204, 206 and 207 are turned off. Thus, an equivalent circuit of the pixel circuit 200 operated in the emission phase E is obtained as illustrated in FIG. 4E.

Figure 4E:
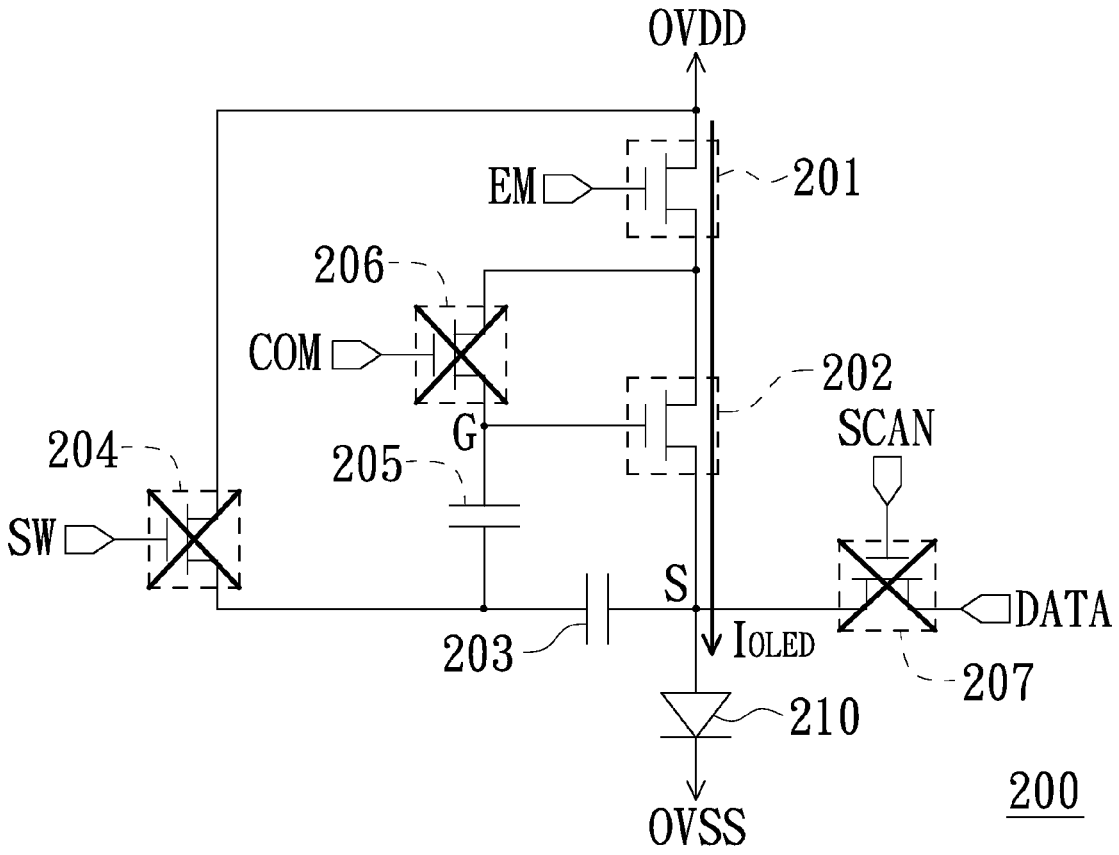
FIG. 4E is an equivalent circuit view of the pixel circuit of FIG. 2 operated in the emission phase.

As illustrated in FIG. 4E, the voltage values of the connecting nodes G and S are obtained by the equations (7) and (8), respectively, which are:

$$V_G=V_{SO}+V_{TH}+\Delta V_S \quad (7)$$

$$V_S=V_{SO}+V_{OLED_E} \quad (8)$$

where $V_G$ is the voltage value of the connecting node G; $V_S$ is the voltage value of the connecting node S; $V_{SO}$ is the threshold voltage of the organic light emitting diode 210; $V_{TH}$ is the threshold voltage of the transistor 202; $\Delta V_S$ is the voltage change value of the connecting node S from data writing phase W to emission phase E and $\Delta V_S=V_{SE}-V_{SW}=(V_{SO}+V_{OLED_E})-V_{DATA}$; $V_{SE}$ is the voltage value of the connecting node S while in the emission phase E and $V_{SW}=V_{DATA}$.

As the illustration of FIG. 4E, the capacitors 203 and 205 are coupled in series due to the transistor 204 is turned off while in the emission phase, accordingly the voltage values of the connecting nodes S and G varies in synchronous manner. In other words, the voltage value of the connecting node S increases with the increasing of the voltage value of the connecting node G and the voltage value of the connecting node S decreases with the decreasing of the voltage value of the connecting node G. Thus, the cross voltage between the control and second terminals of the transistor 202 (i.e., $V_{GS}$) is obtained by the equation (9), which is:

$$V_{GS}=V_{TH}+V_{SO}-V_{DATA} \quad (9)$$

In addition, the current flowing through the organic light emitting diode 210 is obtained by the equation (10), which is:

$$I_{OLED}=K*(V_{GS}-|V_{TH}|)^2 \quad (10)$$

According to the equations (9) and (10), the equation of the current flowing through the organic light emitting diode 210 may be modified to equations (11) and (12), which are:

$$I_{OLED}=K*(V_{TH}+V_{SO}-V_{DATA}-|V_{TH}|)^2 \quad (11)$$

$$I_{OLED}=K*(V_{SO}-V_{DATA})^2 \quad (12)$$

As shown in equation (12), in the emission phase E, the pixel current $I_{OLED}$ flowing through the organic light emitting diode 210 is related to the threshold voltage $V_{SO}$ of the organic light emitting diode 210 and the voltage $V_{DATA}$ of the display data DATA and is unrelated to the power voltage OVDD and the threshold voltage $V_{TH}$ of the transistor 202. Thus, the non-uniformity issue resulted by the IR drop on the organic light emitting diode 210 and the effect of the manufacturing process on the threshold voltage $V_{TH}$ of the transistor 202 is improved effectively in this embodiment. In addition, because the pixel current $I_{OLED}$ increase with the increasing of the threshold voltage $V_{SO}$ of the organic light emitting diode 210, the decreasing of the brightness of the organic light emitting diode 210 is compensated by the increasing of the pixel current $I_{OLED}$ when the organic light emitting diode 210 has material decays.

Figure 5:
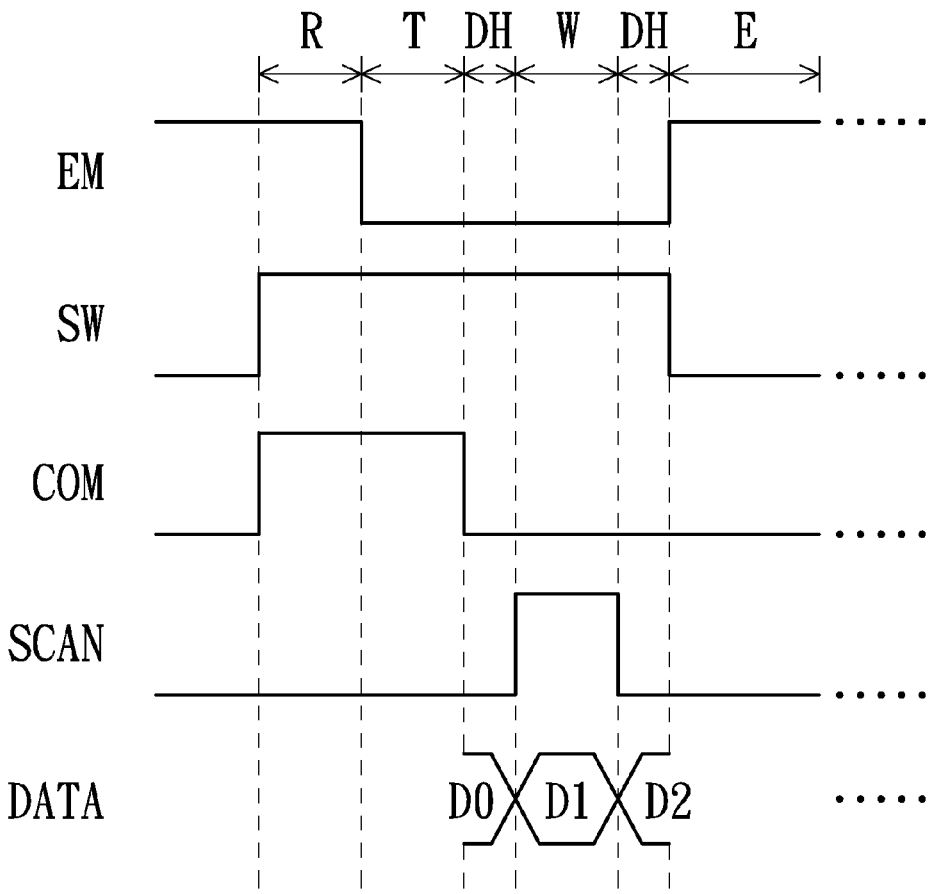
FIG. 5 is another schematic timing sequence view of the signals associated with the pixel circuit of FIG. 2.

In another embodiment, the associated signals in the pixel circuit 200 may have another timing sequence as illustrated in FIG. 5, which is a schematic timing sequence view of the signals associated with the pixel circuit 200 of FIG. 2 in accordance with another embodiment of the present disclosure. It is to be noted that based on the signal configuration illustrated by the timing sequence of FIG. 3, the pixel circuits 200 in the same row are configured to emit light progressively; and based on the signal configuration illustrated by the timing sequence of FIG. 5, the pixel circuits 200 in the same row are configured to emit light simultaneously. In addition, as shown in FIG. 5, the pixel circuits 200 may be further operated in a data holding phase DH; wherein one data holding phase DH is located between the charging phase T and the data writing phase W and another data holding phase DH is located between the data writing phase W and the emission phase E. Specifically, as illustrated in FIG. 5, the enable signal EM, the common signal COM and the scan signal SCAN are configured to have low levels and the switch signal SW is configured to have a high level in each data storing phase DH. In addition, the reset phase R, charging phase T, data holding phase DH, data writing phase W, data holding phase DH and emission phase E are executed sequentially and repeatedly.

Please refer to FIGS. 5 and 2. Because the enable signal EM, the common signal COM and the scan signal SCAN are configured to have low levels and the switch signal SW is configured to have a high level in each data storing phase DH, the transistors 201, 206 and 207 are turned off and the transistor 204 is turned on. Thus, as illustrated in FIG. 5, the display data DATA is latched in each one of the pixel circuits 200 and accordingly all the pixel circuits 200 in the same row can emit light simultaneously in the follow-up emission phase E.

Figure 6:
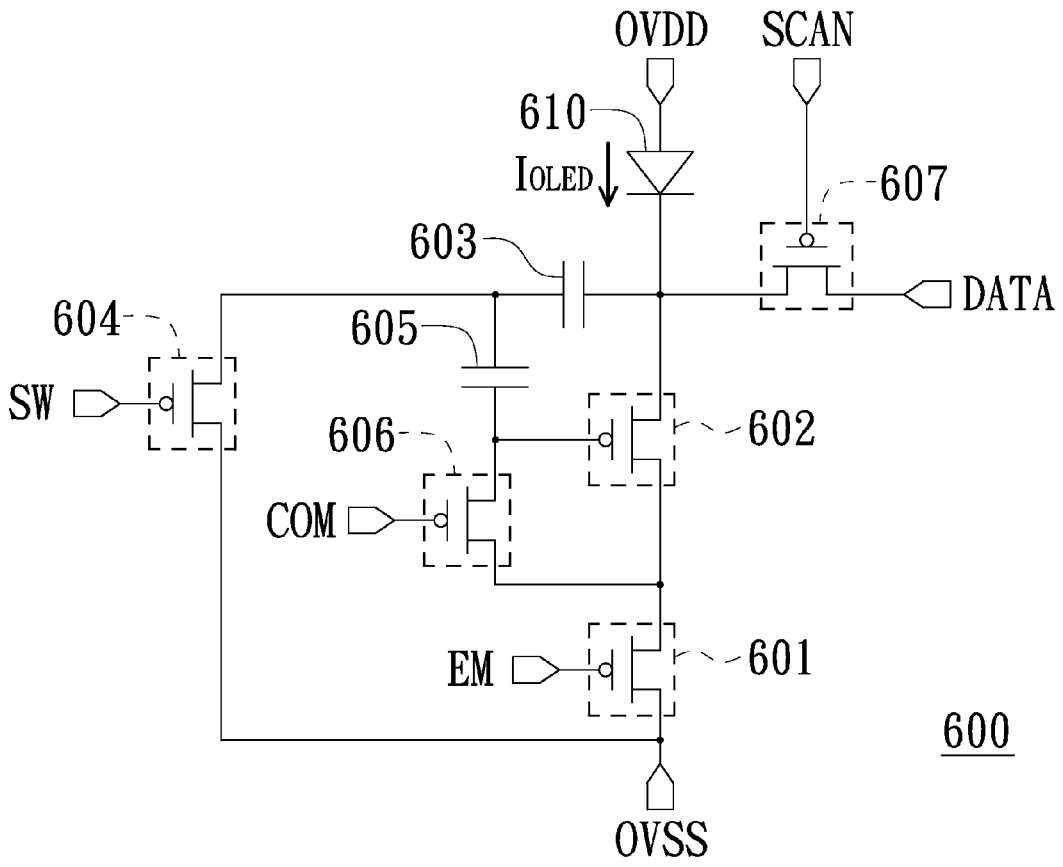
FIG. 6 is a schematic circuit view of a pixel circuit in accordance with another embodiment of the present disclosure.

FIG. 6 is a schematic circuit view of a pixel circuit in accordance with another embodiment of the present disclosure. As shown, the pixel circuit 600 in this embodiment has a circuit structure similar to that of the pixel circuit 200 of FIG. 2; wherein the main difference between the two is that all the transistors in the pixel circuit 600 are implemented by P-type transistors. Specifically, the transistor 601 is configured to have the first terminal thereof electrically coupled to the power voltage OVSS and the control terminal thereof for receiving the enable signal EM. The transistor 602 is configured to have the first terminal thereof connected to the second terminal of the transistor 601 and the second terminal thereof connected to the power voltage OVDD through the organic light emitting diode 610. The capacitor 603 is configured to have the first terminal thereof connected to the second terminal of the transistor 602. The transistor 604 is configured to have the first terminal thereof connected to the power voltage OVSS (or namely the first terminal of the transistor 604 is connected between the power voltage OVSS and the first terminal of the transistor 601), the second terminal thereof connected to the second terminal of the capacitor 603, and the control terminal thereof for receiving the switch signal SW. The capacitor 605 is configured to have the first terminal thereof connected to the control terminal of the transistor 602 and the second terminal thereof electrically coupled to the second terminal the capacitor 603 as well as the second terminal of the transistor 604 (or namely the second terminal of the capacitor 605 is connected between the second terminal of the capacitor 603 and the second terminal of the transistor 604). The transistor 606 is configured to have the first terminal thereof connected to the first terminal of the transistor 602 as well as the second terminal of the transistor 601, the second terminal thereof connected to the control terminal of the transistor 602 as well as the first terminal of the capacitor 605, and the control terminal thereof for receiving the common signal COM. The transistor 607 is configured to have the first terminal thereof for receiving the display data DATA, the second terminal thereof connected to the second terminal of the transistor 602, the first terminal of the capacitor 603 as well as the cathode terminal of the organic light emitting diode 610, and the control terminal thereof for receiving the scan signal SCAN. The organic light emitting diode 610 is configured to have the anode terminal thereof electrically coupled to the power voltage OVDD.

Figure 7:
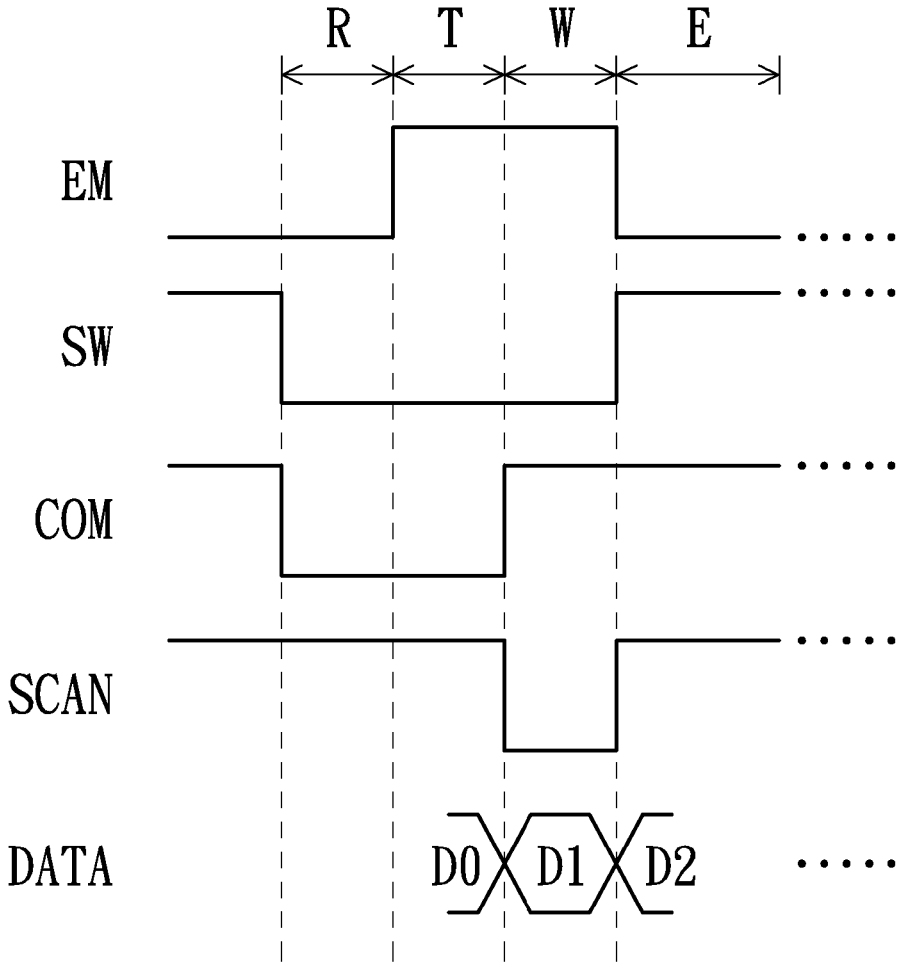
FIG. 7 is a schematic timing sequence view of the signals associated with the pixel circuit of FIG. 6.

FIG. 7 is a schematic timing sequence view of the signals associated with the pixel circuit 600 of FIG. 6. As shown, in the reset phase R, the enable signal EM, the switch signal SW and the common signal COM are configured to have low levels and the scan signal SCAN is configured to have a high level; in the charging phase T, the enable signal EM and the scan signal SCAN are configured to have high levels and the switch signal SW and the common signal COM are configured to have low levels; in the data writing phase W, the enable signal EM and the common signal COM are configured to have high levels and the switch signal SW and the scan signal SCAN are configured to have low levels; in the emission phase E, the enable signal EM is configured to have a low level and the switch signal SW, the common signal COM and the scan signal SCAN are configured to have high levels. Thus, through the aforementioned signal configuration as illustrated in FIG. 7, the pixel current $I_{OLED}$ flowing through the organic light emitting diode 610 is only related to the threshold voltage $V_{SO}$ of the organic light emitting diode 610 and the display data VDATA and is unrelated to the power voltage OVSS and the threshold voltage $V_{TH}$ of the transistor 602. Thus, the non-uniformity issue resulted by the IR drop on the organic light emitting diode 610 and the effect of the manufacturing process on the threshold voltage $V_{TH}$ of the transistor 602 is improved effectively in this embodiment. In addition, because the pixel current $I_{OLED}$ increase with the increasing of the threshold voltage $V_{SO}$ of the organic light emitting diode 610, the decreasing of the brightness of the organic light emitting diode 610 is compensated by the increasing of the pixel current $I_{OLED}$ when the organic light emitting diode 610 has material decays. The operations of the pixel circuit 600 in the reset phase R, charging phase T, data writing phase W and emission phase E are similar to the descriptions in FIGS. 4A, 4B, 4C and 4D, respectively; and no redundant detail is to be given herein. In addition, the reset phase R, charging phase T, data writing phase W and emission phase E are executed sequentially and repeatedly in this embodiment as illustrated in FIG. 7.

Figure 8:
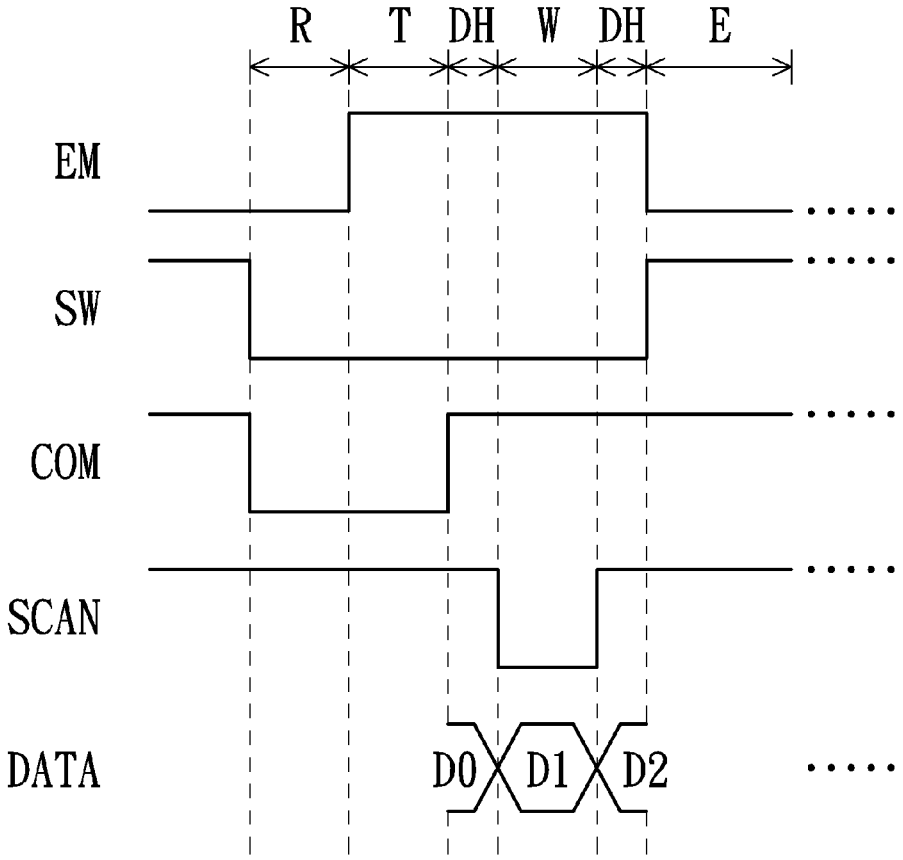
FIG. 8 is another schematic timing sequence view of the signals associated with the pixel circuit of FIG. 6.

In another embodiment, the associated signals in the pixel circuit 600 may have another timing sequence as illustrated in FIG. 8, which is a schematic timing sequence view of the signals associated with the pixel circuit 600 of FIG. 6 in accordance with another embodiment of the present disclosure. It is to be noted that based on the signal configuration illustrated by the timing sequence of FIG. 7, the pixel circuits 600 in the same row are configured to emit light progressively; and based on the signal configuration illustrated by the timing sequence of FIG. 8, the pixel circuits 600 in the same row are configured to emit light simultaneously. In addition, as shown in FIG. 8, the pixel circuits 600 may be further operated in a data holding phase DH; wherein one data holding phase DH is located between the charging phase T and the data writing phase W and another data holding phase DH is located between the data writing phase W and the emission phase E. Specifically, as illustrated in FIG. 8, the enable signal EM, the common signal COM and the scan signal SCAN are configured to have high levels and the switch signal SW is configured to have a low level in each data storing phase DH. In addition, the reset phase R, charging phase T, data holding phase DH, data writing phase W, data holding phase DH and emission phase E are executed sequentially and repeatedly.

Please refer to FIGS. 8 and 6. Because the enable signal EM, the common signal COM and the scan signal SCAN are configured to have high levels and the switch signal SW is configured to have a low level in each data storing phase DH, the transistors 601, 606 and 607 are turned off and the transistor 604 is turned on. Thus, as illustrated in FIG. 6, the display data DATA is latched in each one of the pixel circuits 600 and accordingly all the pixel circuits 600 in the same row can emit light simultaneously in the follow-up emission phase E.

Figure 9:
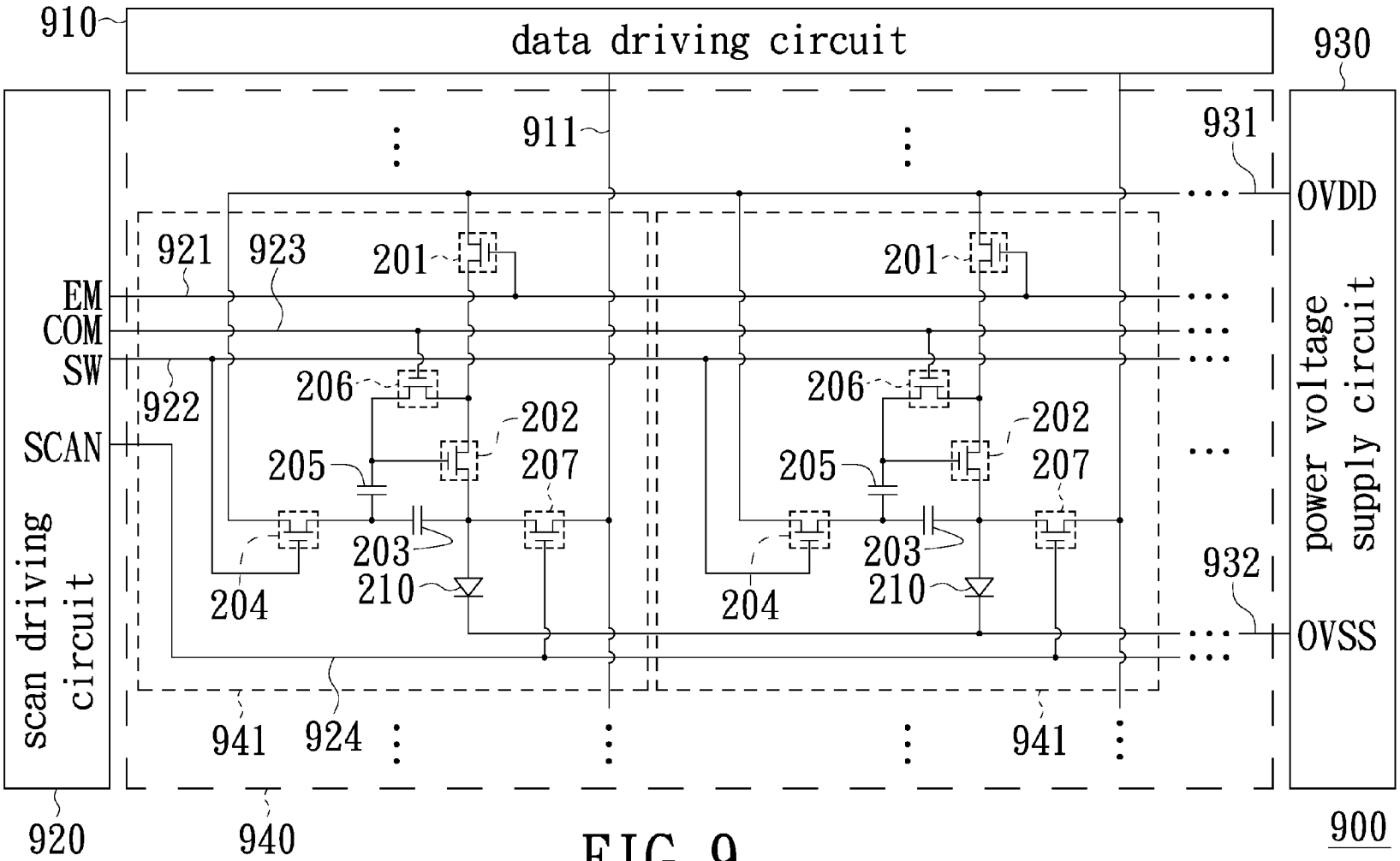
FIG. 9 is a schematic view of a display apparatus in accordance with an embodiment of the present disclosure.

Please refer to FIG. 9, which is a schematic view of a display apparatus in accordance with an embodiment of the present disclosure. As shown, the display apparatus 900 in this embodiment is implemented by organic light emitting diodes and includes a data driving circuit 910, a scan driving circuit 920, a power voltage supply circuit 930 and a display panel 940. The data driving circuit 910 includes a plurality of data lines 911. The scan driving circuit 920 includes a plurality of enable-signal lines 921, a plurality of switch-signal lines 922, a plurality of common-signal lines 923 and a plurality of scan-signal lines 924. The power voltage supply circuit 930 includes at least two power lines 931, 932. The display panel 940 includes a plurality of pixel circuits 941.

In this embodiment, the pixel circuit 941 is implemented by the pixel circuit 200 of FIG. 2. Specifically, in each pixel circuit 941, the transistor 201 is configured to have the first terminal thereof electrically coupled, through the power line 931, to the power voltage supply circuit 930 and from which to receive the power voltage OVDD and the control terminal thereof for receiving the enable signal EM through the enable-signal line 921. The transistor 204 is configured to have the first terminal thereof electrically coupled, through the power line 931, to the power voltage supply circuit 930 and from which to receive the power voltage OVDD and the control terminal thereof for receiving the switch signal SW through the switch-signal line 922. The transistor 206 is configured to have the control terminal thereof for receiving the common signal COM through the common-signal line 923. The transistor 207 is configured to have the first terminal thereof for receiving the display data DATA through the data line 911 and the control terminal thereof for receiving the scan signal SCAN through the scan-signal line 924. The organic light emitting diode 210 is configured to have the cathode terminal thereof electrically coupled, through the power line 932, to the power voltage supply circuit 930 and from which to receive the power voltage OVSS. In addition, the internal connecting relationships among the elements in each pixel circuit 941 have been described in FIG. 2, and no redundant detail is to be given herein.

In this embodiment, the scan driving circuit 920 may be configured to drive each one of the pixel circuits 941 according to the signals with the specific timing sequence of FIG. 3. Please refer to FIGS. 9 and 3. As shown, in the reset phase R, the scan driving circuit 920 is configured to output the high-level enable signal EM, the high-level switch signal SW, the high-level common signal COM and the low-level scan signal SCAN and thereby controlling the transistors 201, 204 and 206 to be turned-on and the transistor 207 to be turned-off. In the charging phase T, the scan driving circuit 920 is configured to output the low-level enable signal EM, the high-level switch signal SW, the high-level common signal COM and the low-level scan signal SCAN and thereby controlling the transistors 201, 207 to be turned-off and the transistor 204, 206 to be turned-on. In the data writing phase W, the scan driving circuit 920 is configured to output the low-level enable signal EM, the high-level switch signal SW, the low-level common signal COM and the high-level scan signal SCAN and thereby controlling the transistors 201, 206 to be turned-off and the transistor 204, 207 to be turned-on. In the emission phase E, the scan driving circuit 920 is configured to output the high-level enable signal EM, the low-level switch signal SW, the low-level common signal COM and the low-level scan signal SCAN and thereby controlling the transistor 201 to be turned-on and the transistor 204, 206 and 207 to be turned-off. In addition, the reset phase R, charging phase T, data writing phase W and emission phase E are executed sequentially and repeatedly in this embodiment as illustrated in FIG. 3. In another embodiment, the scan driving circuit 920 may be configured to drive each one of the pixel circuits 941 according to the signals with the specific timing sequence of FIG. 5.

In the aforementioned embodiment, each one of the pixel circuits 941 is implemented by an N-type transistor. However, it is to be noted that the pixel circuit 941 may be implemented by a P-type transistor (specifically, a P-type thin film transistor), as illustrated in FIG. 6; and accordingly, the scan driving circuit 920 may be configured to drive each one of the pixel circuits 941 according to the signals with the specific timing sequence of FIG. 7 or FIG. 8. To reduce the consumption of power line 932, the organic light emitting diode 210 may be configured to have the cathode terminal thereof grounded directly in one embodiment; and the present disclosure is not limited thereto.

In summary, by using five transistors, two capacitors and one organic light emitting diode to implement the pixel circuit of the present disclosure, the pixel current flowing through the organic light emitting diode is only related to the threshold voltage of the organic light emitting diode and the display data and is unrelated to the power voltage and the threshold voltage of the transistor therein. Thus, the issues of the non-uniformity and the material decay of the organic light emitting diode can be improved effectively by the pixel circuit as well as the display apparatus employing the pixel circuit.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the present claims which are to be accorded with the broadest interpretation so as to encompass all such modifications and similar structures.

What is claimed is:

1. A pixel circuit, comprising:

an organic light emitting diode;

a first transistor configured to have a first terminal thereof electrically coupled to a first power voltage;

a second transistor configured to have a first terminal thereof electrically coupled to a second terminal of the first transistor and a second terminal thereof electrically coupled to a second power voltage through the organic light emitting diode;

a first capacitor configured to have a first terminal thereof electrically coupled to the second terminal of the second transistor;

a third transistor configured to have a first terminal thereof directly coupled to the first power voltage and a second terminal thereof directly coupled to a second terminal of the first capacitor;

a second capacitor configured to have a first terminal thereof electrically coupled to a control terminal of the second transistor and a second terminal thereof directly coupled to the second terminal of the first capacitor;

a fourth transistor configured to have a first terminal thereof directly coupled to the first terminal of the second transistor and a second terminal thereof electrically coupled to a control terminal of the second transistor; and a fifth transistor configured to have a second terminal thereof directly coupled to the second terminal of the second transistor.

2. The pixel circuit according to claim 1, wherein the first transistor is further configured to have a control terminal thereof for receiving an enable signal; the third transistor is further configured to have a control terminal thereof for receiving a switch signal; the fourth transistor is further configured to have a control terminal thereof for receiving a common signal; the fifth transistor is further configured to have a first terminal thereof for receiving a display data and a control terminal thereof for receiving a scan signal.

3. The pixel circuit according to claim 2, wherein in a reset phase, the first, the third and the fourth transistors are configured to be turned on according to the signals received by the control terminals thereof, respectively, and the fifth transistor is configured to be turned off according to the signal received by the control terminal thereof; wherein in a charging phase, the first and the fifth transistors are configured to be turned off according to the signals received by the control terminals thereof, respectively, and the third and the fourth transistors are configured to be turned on according to the signals received by the control terminals thereof, respectively; wherein in a data writing phase, the first and the fourth transistors are configured to be turned off according to the signals received by the control terminals thereof, respectively, and the third and the fifth transistors are configured to be turned on according to the signals received by the control terminals thereof, respectively; wherein in an emission phase, the first transistor is configured to be turned on according to the signal received by the control terminal thereof and the third, the fourth and the fifth transistors are configured to be turned off according to the signals received by the control terminals thereof, respectively.

4. The pixel circuit according to claim 3, wherein the reset phase, the charging phase, the data writing phase and the emission phases are executed sequentially.

5. The pixel circuit according to claim 2, wherein the enable signal, the switch signal and the common signal are configured to have high levels and the scan signal is configured to have a low level in a reset phase; wherein the enable signal and the scam signal are configured to have low levels and the switch signal and the common signal are configured to have high levels in a charging phase; wherein the enable signal and the common signal are configured to have low levels and the switch signal and the scan signal are configured to have high levels in a data writing phase; wherein the enable signal is configured to have a high level and the switch signal, the common signal and the scan signal are configured to have low levels in an emission phase.

6. The pixel circuit according to claim 5, wherein the reset phase, the charging phase, the data writing phase and the emission phases are executed sequentially.

7. The pixel circuit according to claim 2, wherein the enable signal, the switch signal and the common signal are configured to have high levels and the scan signal is configured to have a low level in a reset phase; wherein the enable signal and the scam signal are configured to have low levels and the switch signal and the common signal are configured to have high levels in a charging phase; wherein the enable signal, the common signal and the scan signal are configured to have low levels and the switch signal is configured to have a high level in a first data storing phase; wherein the enable signal and the common signal are configured to have low levels and the switch signal and the scan signal are configured to have high levels in a data writing phase; wherein the enable signal, the common signal and the scan signal are configured to have low levels and the switch signal is configured to have a high level in a second data storing phase; wherein the enable signal is configured to have a high level and the switch signal, the common signal and the scan signal are configured to have low levels in an emission phase.

8. The pixel circuit according to claim 2, wherein the enable signal, the switch signal and the common signal are configured to have low levels and the scan signal is configured to have a high level in a reset phase; wherein the enable signal and the scam signal are configured to have high levels and the switch signal and the common signal are configured to have low levels in a charging phase; wherein the enable signal and the common signal are configured to have high levels and the switch signal and the scan signal are configured to have low levels in a data writing phase; wherein the enable signal is configured to have a low level and the switch signal, the common signal and the scan signal are configured to have high levels in an emission phase.

9. The pixel circuit according to claim 2, wherein the enable signal, the switch signal and the common signal are configured to have low levels and the scan signal is configured to have a high level in a reset phase; wherein the enable signal and the scam signal are configured to have high levels and the switch signal and the common signal are configured to have low levels in a charging phase; wherein the enable signal, the common signal and the scan signal are configured to have high levels and the switch signal is configured to have a low level in a first data storing phase; wherein the enable signal and the common signal are configured to have high levels and the switch signal and the scan signal are configured to have low levels in a data writing phase; wherein the enable signal, the common signal and the scan signal are configured to have high levels and the switch signal is configured to have a low level in a second data storing phase; wherein the enable signal is configured to have a low level and the switch signal, the common signal and the scan signal are configured to have high levels in an emission phase.

10. The pixel circuit according to claim 9, wherein the reset phase, the charging phase, the first data storing phase, the data writing phase, the second data storing phase and the emission phases are executed sequentially.

11. A display apparatus, comprising:

a plurality of pixel circuits, each one of the pixel circuits comprising:

an organic light emitting diode;

a first transistor configured to have a first terminal thereof electrically coupled to a first power voltage;

a second transistor configured to have a first terminal thereof electrically coupled to a second terminal of the first transistor and a second terminal thereof electrically coupled to a second power voltage through the organic light emitting diode;

a first capacitor configured to have a first terminal thereof electrically coupled to the second terminal of the second transistor;

a third transistor configured to have a first terminal thereof directly coupled to the first power voltage and a second terminal thereof directly coupled to a second terminal of the first capacitor;

a second capacitor configured to have a first terminal thereof electrically coupled to a control terminal of the second transistor and a second terminal thereof directly coupled to the second terminal of the first capacitor;

a fourth transistor configured to have a first terminal thereof directly coupled to the first terminal of the second transistor and a second terminal thereof electrically coupled to a control terminal of the second transistor; and a fifth transistor configured to have a second terminal thereof directly coupled to the second terminal of the second transistor.

12. The display apparatus according to claim 11, wherein the first transistor is further configured to have a control terminal thereof for receiving an enable signal; the third transistor is further configured to have a control terminal thereof for receiving a switch signal; the fourth transistor is further configured to have a control terminal thereof for receiving a common signal; the fifth transistor is further configured to have a first terminal thereof for receiving a display data and a control terminal thereof for receiving a scan signal.

13. The display apparatus according to claim 12, wherein in a reset phase, the first, the third and the fourth transistors are configured to be turned on according to the signals received by the control terminals thereof, respectively, and the fifth transistor is configured to be turned off according to the signal received by the control terminal thereof; wherein in a charging phase, the first and the fifth transistors are configured to be turned off according to the signals received by the control terminals thereof, respectively, and the third and the fourth transistors are configured to be turned on according to the signals received by the control terminals thereof, respectively; wherein in a data writing phase, the first and the fourth transistors are configured to be turned off according to the signals received by the control terminals thereof, respectively, and the third and the fifth transistors are configured to be turned on according to the signals received by the control terminals thereof, respectively; wherein in an emission phase, the first transistor is configured to be turned on according to the signal received by the control terminal thereof and the third, the fourth and the fifth transistors are configured to be turned off according to the signals received by the control terminals thereof, respectively.

14. The display apparatus according to claim 13, wherein the reset phase, the charging phase, the data writing phase and the emission phases are executed sequentially.

15. The display apparatus according to claim 12, wherein the enable signal, the switch signal and the common signal are configured to have high levels and the scan signal is configured to have a low level in a reset phase; wherein the enable signal and the scam signal are configured to have low levels and the switch signal and the common signal are configured to have high levels in a charging phase; wherein the enable signal and the common signal are configured to have low levels and the switch signal and the scan signal are configured to have high levels in a data writing phase; wherein the enable signal is configured to have a high level and the switch signal, the common signal and the scan signal are configured to have low levels in an emission phase.

16. The display apparatus according to claim 15, wherein the reset phase, the charging phase, the data writing phase and the emission phases are executed sequentially.

17. The display apparatus according to claim 12, wherein the enable signal, the switch signal and the common signal are configured to have high levels and the scan signal is configured to have a low level in a reset phase; wherein the enable signal and the scam signal are configured to have low levels and the switch signal and the common signal are configured to have high levels in a charging phase; wherein the enable signal, the common signal and the scan signal are configured to have low levels and the switch signal is configured to have a high level in a first data storing phase; wherein the enable signal and the common signal are configured to have low levels and the switch signal and the scan signal are configured to have high levels in a data writing phase; wherein the enable signal, the common signal and the scan signal are configured to have low levels and the switch signal is configured to have a high level in a second data storing phase; wherein the enable signal is configured to have a high level and the switch signal, the common signal and the scan signal are configured to have low levels in an emission phase.

18. The display apparatus according to claim 12, wherein the enable signal, the switch signal and the common signal are configured to have low levels and the scan signal is configured to have a high level in a reset phase; wherein the enable signal and the scam signal are configured to have high levels and the switch signal and the common signal are configured to have low levels in a charging phase; wherein the enable signal and the common signal are configured to have high levels and the switch signal and the scan signal are configured to have low levels in a data writing phase; wherein the enable signal is configured to have a low level and the switch signal, the common signal and the scan signal are configured to have high levels in an emission phase.

19. The display apparatus according to claim 12, wherein the enable signal, the switch signal and the common signal are configured to have low levels and the scan signal is configured to have a high level in a reset phase; wherein the enable signal and the scam signal are configured to have high levels and the switch signal and the common signal are configured to have low levels in a charging phase; wherein the enable signal, the common signal and the scan signal are configured to have high levels and the switch signal is configured to have a low level in a first data storing phase; wherein the enable signal and the common signal are configured to have high levels and the switch signal and the scan signal are configured to have low levels in a data writing phase; wherein the enable signal, the common signal and the scan signal are configured to have high levels and the switch signal is configured to have a low level in a second data storing phase; wherein the enable signal is configured to have a low level and the switch signal, the common signal and the scan signal are configured to have high levels in an emission phase.

20. The display apparatus according to claim 19, wherein the reset phase, the charging phase, the first data storing phase, the data writing phase, the second data storing phase and the emission phases are executed sequentially.

* * * * *